US007756457B2

(12) United States Patent
Hamilton et al.

(10) Patent No.: US 7,756,457 B2
(45) Date of Patent: Jul. 13, 2010

(54) FUSER ASSEMBLY HAVING SELECTABLE FUSER DETACK MECHANISM

(75) Inventors: Douglas Campbell Hamilton, Lexington, KY (US); Clark Edwin Jarnagin, Lexington, KY (US); William Thomas Kearney, III, Lexington, KY (US); Thomas Paul Maddox, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 267 days.

(21) Appl. No.: 11/858,170

(22) Filed: Sep. 20, 2007

(65) Prior Publication Data

US 2009/0080953 A1 Mar. 26, 2009

(51) Int. Cl.
*G03G 15/20* (2006.01)

(52) U.S. Cl. ..... 399/323

(58) Field of Classification Search ..... 399/323, 399/67, 68

See application file for complete search history.

(56) References Cited

U.S. PATENT DOCUMENTS 5,548,389 A * 8/1996 Bowler, Jr. ..... 399/323
5,802,434 A * 9/1998 Takehara et al. ..... 399/323
5,956,547 A * 9/1999 Kamei et al.
6,205,316 B1 * 3/2001 Iida ..... 399/323
6,640,062 B2 * 10/2003 Tsubaki et al. ..... 399/323
6,810,229 B2 * 10/2004 Coleman et al. ..... 399/323
7,565,101 B2 * 7/2009 Yamanaka et al. ..... 399/323
2007/0048036 A1 * 3/2007 Kanematsu et al. ..... 399/323
2007/0280752 A1 * 12/2007 Uchida ..... 399/323
2008/0124140 A1 * 5/2008 Thomas et al. ..... 399/323

* cited by examiner

*Primary Examiner*—Susan S Lee

(57) ABSTRACT

A fuser assembly includes a fuser housing, a fuser roller rotatably mounted to the fuser housing, an actuator mechanism, and a fuser detack mechanism. The fuser detack mechanism includes a detack housing pivotably mounted to the fuser housing. The fuser detack mechanism is pivoted from a first position to a second position when the actuator mechanism is actuated. A plurality of detack fingers is mounted to the detack housing. Each of the plurality of detack fingers has a distal end, wherein when the fuser detack mechanism is in the first position, the distal end of each of the plurality of detack fingers is positioned to be disengaged from an exterior surface of the fuser roller, and when the fuser detack mechanism is in the second position, the distal end of each of the plurality of detack fingers is positioned to be engaged with the exterior surface of the fuser roller.

16 Claims, 5 Drawing Sheets

FUSER ASSEMBLY HAVING SELECTABLE FUSER DETACK MECHANISM

CROSS-REFERENCE TO RELATED APPLICATIONS

None.

MICROFICHE APPENDIX

None.

GOVERNMENT RIGHTS IN PATENT

None.

BACKGROUND OF THE INVENTION

1. Field of the Invention

The present invention relates to an electrophotographic apparatus, and, more particularly, to a fuser assembly that has a selectable fuser detack mechanism.

2. Description of the Related Art

An electrophotographic imaging apparatus, such as a laser printer, forms a latent image on a surface of a photoconductive material by selectively exposing an area of the surface to light. The latent electrostatic image is developed into a visible image by electrostatic toners which contain pigment components and thermoplastic components. The photoconductor may be either positively or negatively charged, and the toner system similarly may contain negatively or positively charged particles. A print medium (e.g., a sheet of paper) or intermediate transfer medium is given an electrostatic charge opposite that of the toner and then passed close to a surface of the photoconductor, pulling the toner from the photoconductor onto the paper or intermediate medium in the pattern of the image developed from the photoconductor. After the image is transferred to the print medium, the print medium is processed through a fuser assembly where it is heated and pressed.

In a fuser assembly system, media may stick to the fuser roller. One method of detacking (i.e., separating) the media from the fuser roller to avoid a media jam in the fuser assembly is to provide detack fingers in constant contact with the surface of the fuser roller so as to strip the media from the outer surface of the fuser roller. Such an approach, however, results in increased wear of the fuser roller.

Another approach is to have a set of detack fingers positioned a predetermined fixed minimum distance away from the outer surface of the fuser roller. While this approach does not result in premature wearing of the outer surface of the fuser roller, some media, such as short grain media, recycled media, labels, may tend to slip between the detack fingers and the fuser roller, resulting in media wrapping around the fuser roller that in turn jams the fuser assembly.

What is needed in the art is a fuser assembly configured with a device to avoid media wrapping of the fuser roller, while addressing the shortcomings of the prior methods described above.

SUMMARY OF THE INVENTION

The present invention provides a fuser assembly configured with a device to avoid media wrapping of the fuser roller.

The terms "first" and "second" preceding an element name, e.g., first position, second position, etc., are used for identification purposes to distinguish between similar or related elements, and are not intended to necessarily imply order, nor are the terms "first" and "second" intended to preclude the inclusion of additional similar or related elements.

The invention, in one form thereof, is directed to a fuser assembly. The fuser assembly includes a fuser housing and a fuser roller rotatably mounted to the fuser housing. The fuser roller has an exterior surface. The fuser assembly includes an actuator mechanism and a fuser detack mechanism. The fuser detack mechanism includes a detack housing pivotably mounted to the fuser housing. The fuser detack mechanism is pivoted from a first position to a second position when the actuator mechanism is actuated. A plurality of detack fingers is mounted to the detack housing. Each of the plurality of detack fingers has a distal end, wherein when the fuser detack mechanism is in the first position, the distal end of each of the plurality of detack fingers is positioned to be disengaged from the exterior surface of the fuser roller, and when the fuser detack mechanism is in the second position, the distal end of each of the plurality of detack fingers is positioned to be engaged with the exterior surface of the fuser roller.

The invention, in another form thereof, is directed to a method for operating a fuser assembly having a fuser roller and a backup roller engaged with the fuser roller to form a fuser nip. The method includes positioning a plurality of detack fingers in a first position disengaged from an exterior surface of the fuser roller; and positioning the plurality of detack fingers in a second position engaged with the exterior surface of the fuser roller when a sheet of media enters the fuser nip.

The invention, in another form thereof, is directed to an imaging apparatus for forming a toner image on a sheet of media. The imaging apparatus includes a media feed section for feeding the sheet of media along a media feed path in a sheet feed direction. A laser scanning device is configured to produce a scanned light beam. An image-forming device has a photosensitive body, and is configured to use the scanned light beam to form a latent image on the photosensitive body and develop the latent image to form a toner image that is transferred to the sheet of media. A control circuit is communicatively coupled to an actuator mechanism. The imaging apparatus also includes a fuser housing, a fuser roller rotatably mounted to the fuser housing, and a fuser detack mechanism. The fuser detack mechanism includes a detack housing pivotably mounted to the fuser housing. The fuser detack mechanism is pivoted from a first position to a second position when the actuator mechanism is actuated. A plurality of detack fingers is mounted to the detack housing. Each of the plurality of detack fingers has a distal end, wherein when the fuser detack mechanism is in the first position, the distal end of each of the plurality of detack fingers is positioned to be disengaged from an exterior surface of the fuser roller, and when the fuser detack mechanism is in the second position, the distal end of each of the plurality of detack fingers is positioned to be engaged with the exterior surface of the fuser roller.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate an embodiment of the invention, in one form, and such exemplifications are not to be construed as limiting the scope of the invention in any manner.

DETAILED DESCRIPTION OF THE INVENTION

Figure 1:
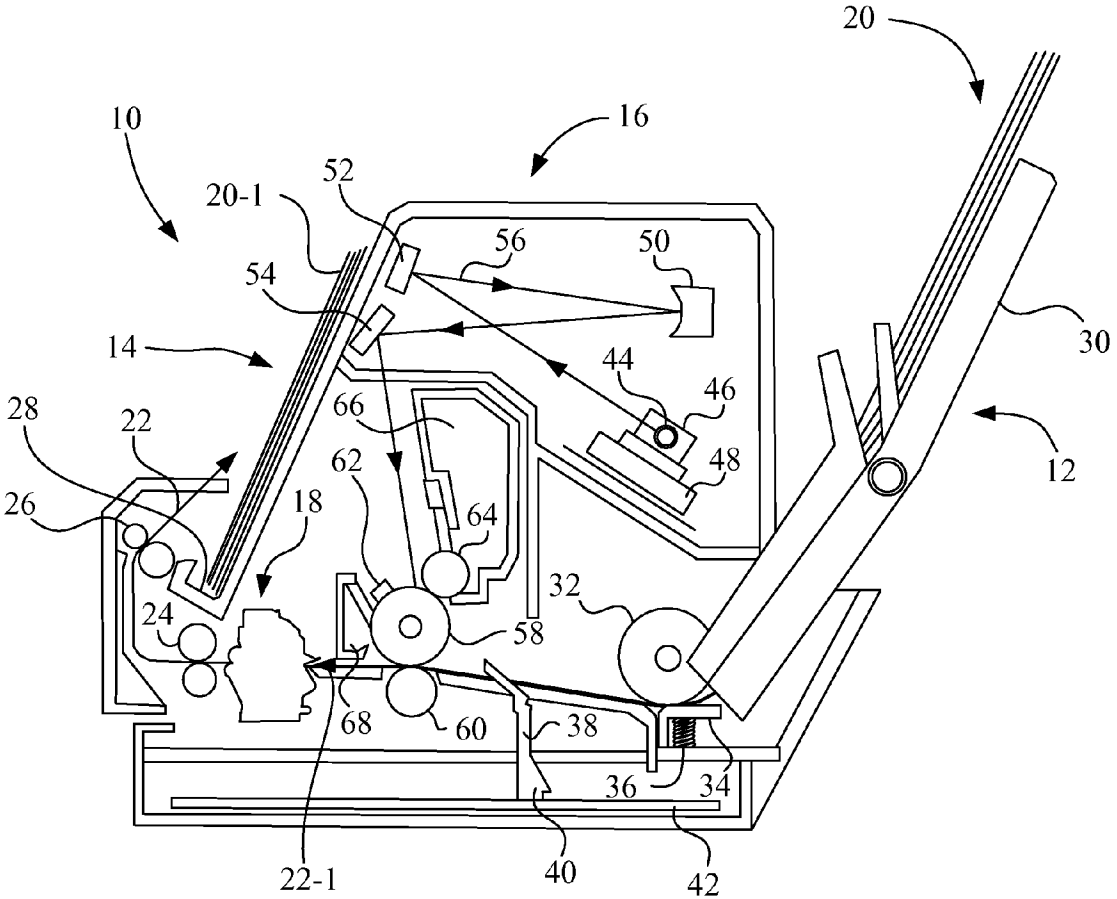
FIG. 1 is a diagrammatic representation of an electrophotographic imaging apparatus having a fuser assembly configured in accordance with an embodiment of the present invention.

Referring now to the drawings and particularly to FIG. 1, there is shown an exemplary electrophotographic imaging apparatus 10, e.g., a laser printer and/or copier, configured in accordance with an embodiment of the present invention. Imaging apparatus 10 includes a media feed section 12, an image-forming device 14, a laser scanning device 16, and a fuser assembly 18.

Media feed section 12 sequentially transports a sheet of media (e.g., paper) 20-1 from a stack of sheets of media 20 to image-forming device 14. A media feed direction is indicated by the arrows on the sheet of media 20-1. Each sheet of media 20-1 moves along a media feed path 22 in a sheet feed direction 22-1. Image-forming device 14 transfers a toner image to the transported sheet of media 20-1. Fuser assembly 18 fixes the toner image to the sheet of media 20-1 sent from image-forming device 14. Thereafter, the sheet of media 20-1 is ejected out of imaging apparatus 10 by media transport rollers 24, 26 and into output tray 28.

In the exemplary imaging apparatus 10, the media feed section 12 includes a feed tray 30, a feed roller 32, a media separating friction plate 34, a pressure spring 36, a media detection actuator 38, a media detection sensor 40, and a controller 42. Controller 42 includes a processor unit and associated memory, and may be formed as one or more Application Specific Integrated Circuits (ASIC).

Upon receiving a print instruction, the sheets of media 20 which have been placed in media feed tray 30 are fed one-by-one by operation of feed roller 32, media separating friction plate 34 and pressure spring 36. As the fed sheet of media 20-1 pushes down media detection actuator 38, media detection sensor 40 outputs an electrical signal instructing commencement of printing of the image. Controller 42, started by operation of media detection actuator 38, transmits an image signal to a laser diode light-emitting unit 44 of laser scanning device 16 so as to control the ON/OFF condition of its associated light-emitting diode.

Laser scanning device 16 includes laser diode light-emitting unit 44, a scanning mirror 46, a scanning mirror motor 48, and reflecting mirrors 50, 52, and 54. Scanning mirror 46 is rotated at a constant high speed by scanning mirror motor 48 such that laser light beam 56 produces a scan. The laser light beam 56 radiated by laser diode light-emitting unit 44 is reflected by reflecting mirrors 50, 52, and 54 so as to be applied to a photosensitive body 58 of image-forming device 14. When the laser light beam 56 is applied to photosensitive body 58, photosensitive body 58 is selectively exposed to the laser light beam 56 in accordance with ON/OFF information from controller 42.

In addition to photosensitive body 58, image-forming device 14 includes a transfer roller 60, a charging member 62, and a developer, including a developing roller 64, a developing unit 66, and a cleaning unit 68. The surface charge of photosensitive body 58, charged in advance by charging member 62, is selectively discharged by the laser light beam 56. An electrostatic latent image is thus formed on the surface of photosensitive body 58. The electrostatic latent image is visualized by developing roller 64, and developing unit 66. Specifically, the toner supplied from developing unit 66 is adhered to the electrostatic latent image on photosensitive body 58 by developing roller 64 so as to form the toner image.

Toner used for development is stored in developing unit 66. The toner contains coloring components (such as carbon black for black toner) and thermoplastic components. The toner, charged by being appropriately stirred in developing unit 66, adheres to the above-mentioned electrostatic latent image by an interaction of the developing bias voltage applied to developing roller 64 and an electric field generated by the surface potential of photosensitive body 58, and thus conforms to the latent image, forming a visual toner image on photosensitive body 58. The toner typically has a negative charge when it is applied to the latent image, forming the visual toner image.

The sheet of media 20-1 transported from media feed section 12 is transported downstream while being pinched by photosensitive body 58 and transfer roller 60. The sheet of media 20-1 arrives at the transfer nip in timed coordination with the toned image on the photosensitive body 58. As the sheet of media 20-1 is transported downstream, the toner image formed on photosensitive body 58 is electrically attracted and transferred to the sheet of media 20-1 by an interaction with the electrostatic field generated by transfer voltage applied to transfer roller 60. Any toner that still remains on photosensitive body 58, not having been transferred to the sheet of media 20-1, is collected by cleaning unit 68. Thereafter, the sheet of media 20-1 is transported to fuser assembly 18.

Figure 2:
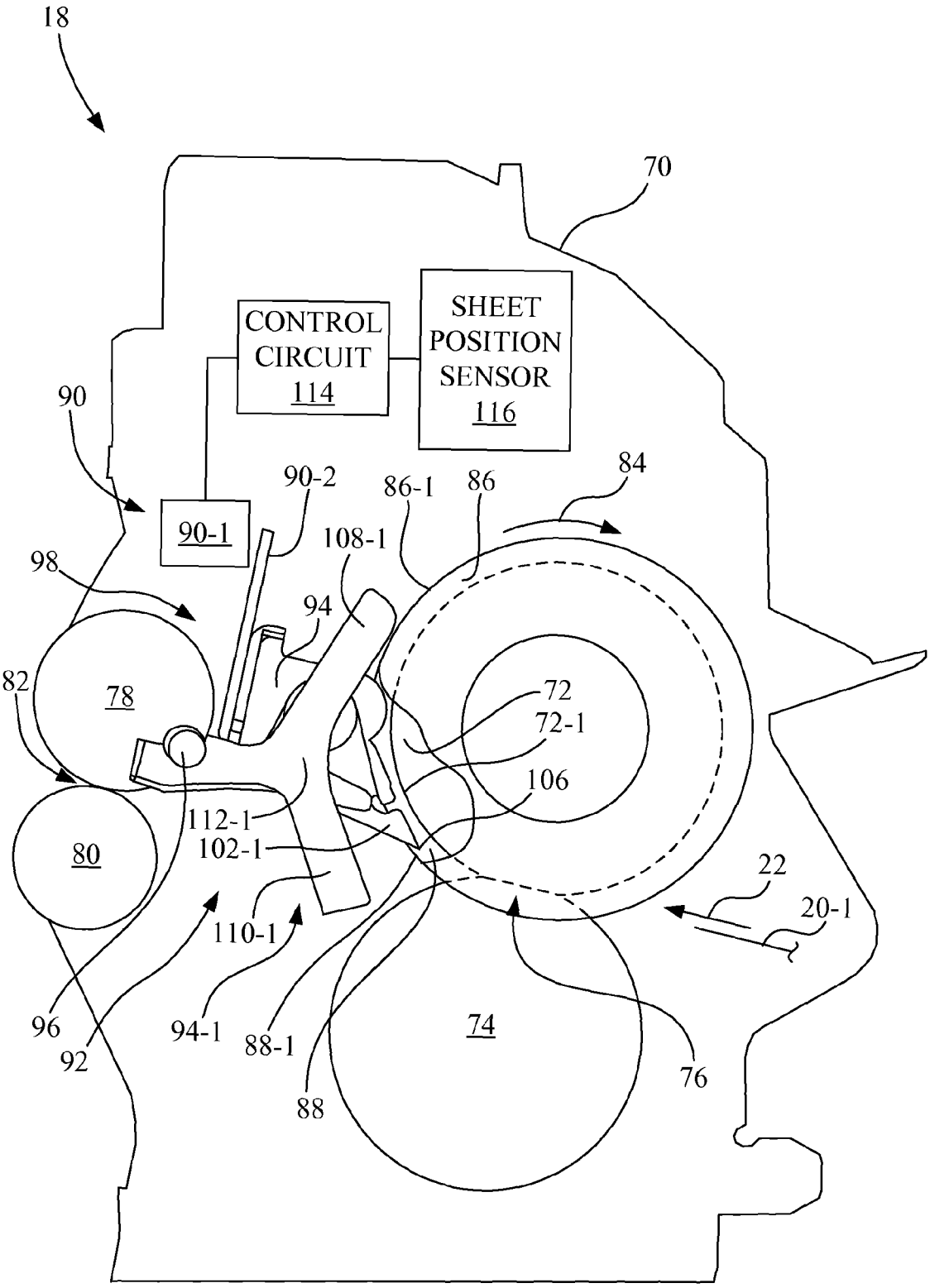
FIG. 2 is a diagrammatic side view of the fuser assembly of FIG. 1, with the fuser detack mechanism in a first position.
Figure 3:
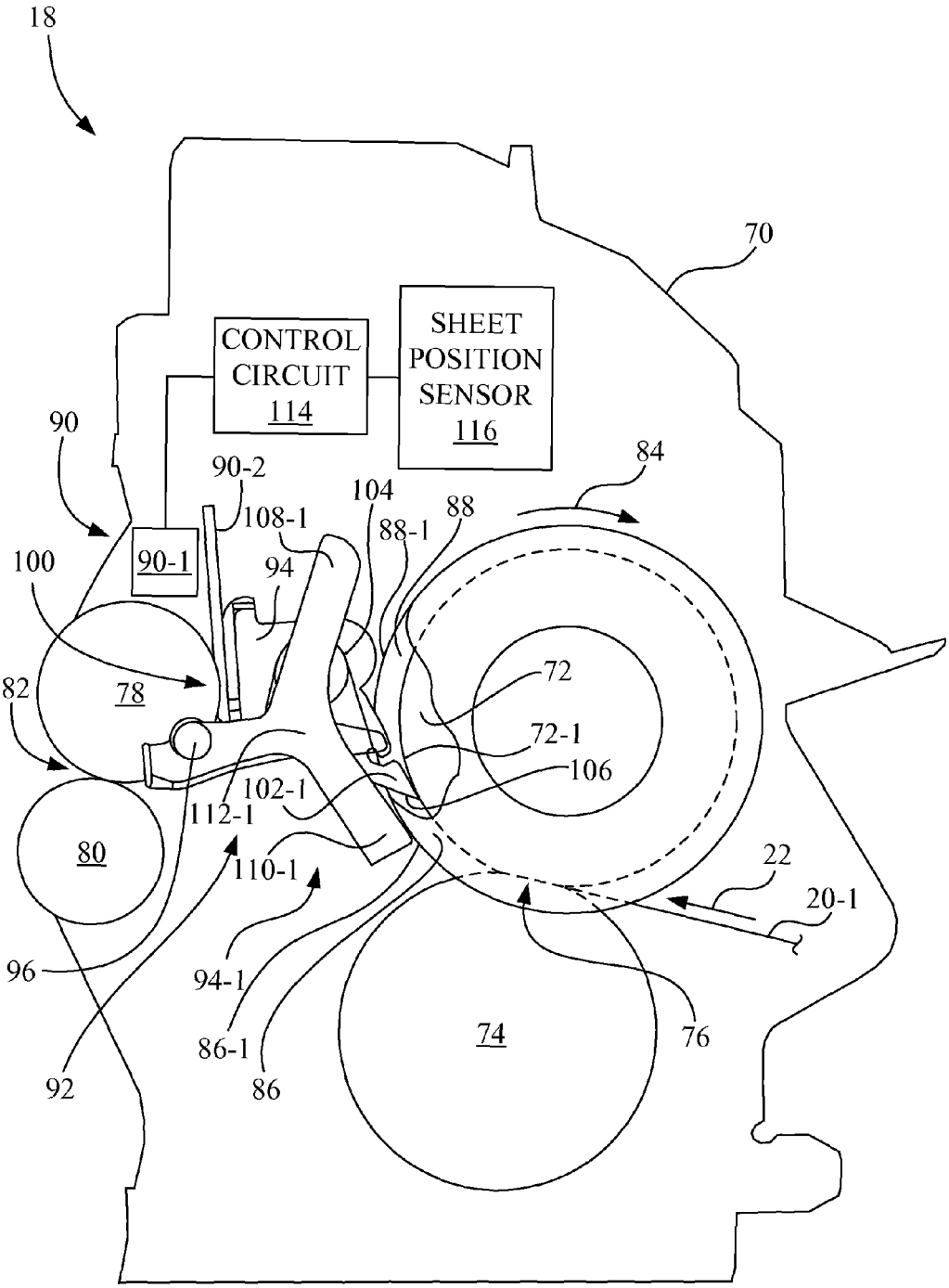
FIG. 3 is a diagrammatic side view of the fuser assembly of FIG. 1, with the fuser detack mechanism in a second position.

Referring now to FIGS. 2 and 3, there is shown fuser assembly 18 configured in accordance with an embodiment of the present invention.

Fuser assembly 18 includes a fuser housing 70 which rotatably mounts a fuser roller 72 and a driven backup roller 74. Fuser roller 72 and a backup roller 74 engage to form a fuser nip 76. Fuser roller 72, backup roller 74, and fuser nip 76 extend across the width of media feed path 22 (see FIG. 1), and may be, for example, about nine to ten inches in length. Fuser housing 70 further mounts an exit roller 78 and a corresponding idler roller 80. Exit roller 78 and idler roller 80 engage to form an exit nip 82.

Fuser roller 72 is rotated in a direction of rotation 84 by an external device (not shown). Fuser roller 72, subjected to heat from a heater assembly (not shown), melts and fixes (i.e., fuses) the toner to the surface of the sheet of media 20-1, such as paper, thereby producing the printed image. Exit roller 78 and idler roller 80 transport the sheet of media 20-1 having the fused image out of fuser assembly 18.

The backup (i.e., pressure) roller 74 may be made from, or is coated with, a material that has good release and transport properties for the sheet of media being processed through fuser assembly 18. For example, backup roller 74 may have a metal core with a silicone rubber layer molded or adhesively bonded onto its surface, or alternatively, backup roller 74 may also have a fluoropolymer, e.g., Teflon® sleeve or coating.

Backup roller 74 may be sufficiently soft so as to allow it to be rotated against fuser roller 72 at fuser nip 76. As a printed sheet of media 20-1 passes through fuser nip 76, the sheet is placed under pressure, and the combined effects of this pressure, the time the sheet is in fuser nip 76, and the heat from fuser roller 72 acts to fix the toner onto the sheet of media 20-1.

Fuser roller 72 may be, for example, a metal tube. Fuser roller 72 may have an outer coating of, for example, a fluororesin or Teflon® material to optimize release properties of the fixed toner. Fuser roller 72 has an exterior surface 72-1.

Fuser roller 72 is rotatably mounted to fuser housing 70 via bearing 86 and bearing 88. Each of bearings 86, 88 may be, for example, a ball bearing, bushing, etc. Bearing 86 has a perimetrical bearing housing 86-1, and bearing 88 has a perimetrical bearing housing 88-1. Fuser roller 72 is positioned between and supported by bearings 86, 88.

Fuser assembly 18 further includes an actuator mechanism 90 and a fuser detack mechanism 92. As used herein, the term "detack" means separation. Fuser detack mechanism 92 includes a detack housing 94 pivotably mounted to fuser housing 70 via a pivot mechanism 96, such as a pin/hole arrangement. Fuser detack mechanism 92 is configured to pivot from a first position 98 (FIG. 2) to a second position 100 (FIG. 3) when actuator mechanism 90 is actuated. Detack housing 94, and in turn fuser detack mechanism 92, is positioned in first position 98 by a force of gravity when actuator mechanism 90 is de-actuated.

Figure 4:
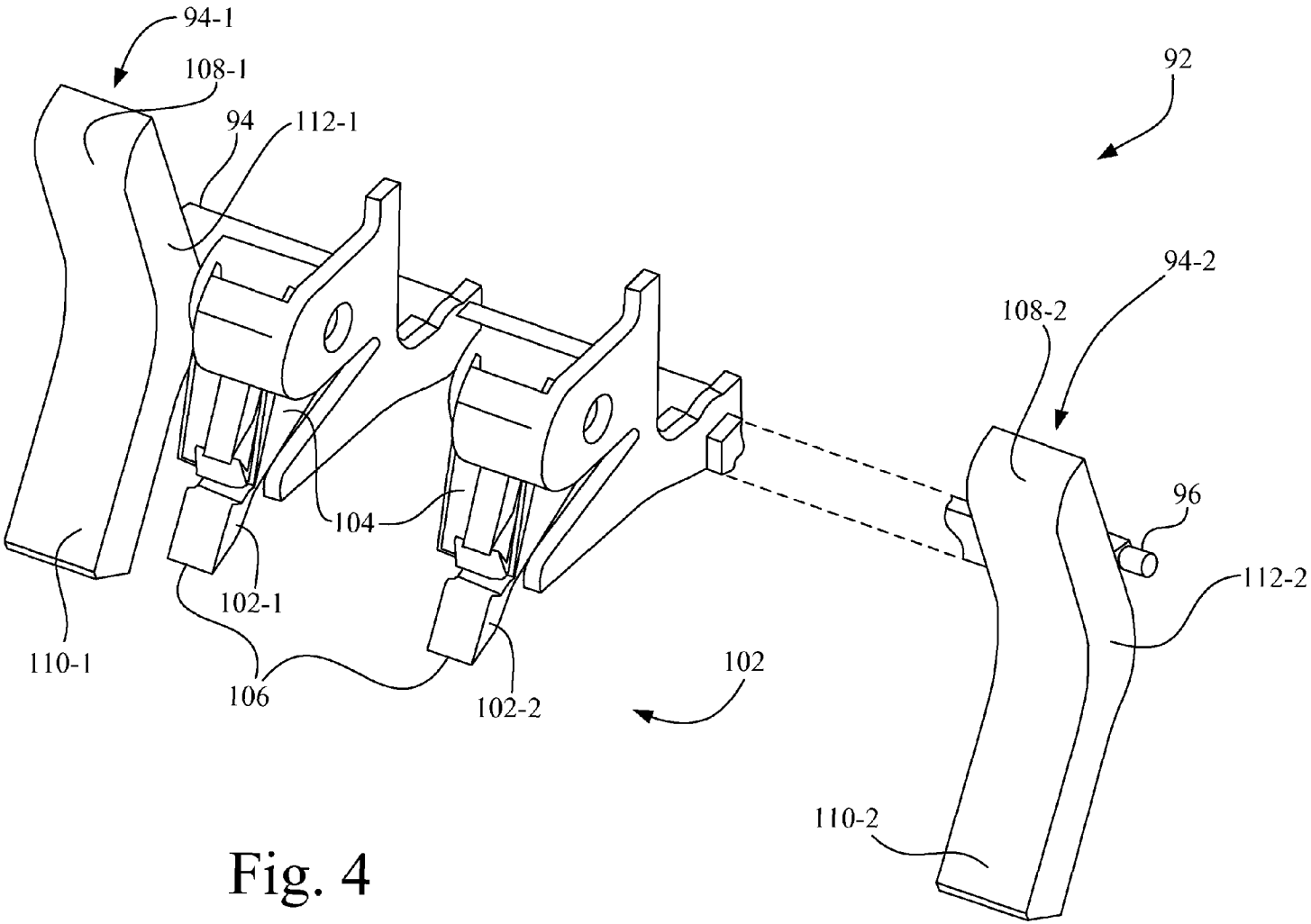
FIG. 4 is a perspective view of a portion of the fuser detack mechanism shown in FIGS. 2 and 3.

Referring also to FIG. 4, fuser detack mechanism 92 also includes a plurality of detack fingers 102 (individually identified in FIG. 4 as detack finger 102-1, detack finger 102-2 . . . , etc. In one embodiment, for example, five detack fingers may be positioned along the length of fuser roller 72 across the width of media feed path 22. Each of the plurality of detack fingers 102 is individually mounted to detack housing 94 by a spring-loaded mechanism 104 (which may include a torsion spring) to bias the plurality of detack fingers 102 in a direction toward fuser roller 72. Each of the plurality of detack fingers 102 have distal end 106. In FIGS. 2 and 3, bearing 86 has a portion broken away to expose distal end 106 and the opposite bearing 88 to aid in understanding the operation of the present embodiment.

Referring to FIGS. 2 and 4, when fuser detack mechanism 92 is in first position 98, the distal end 106 of each of the plurality of detack fingers 102 is positioned to be disengaged from exterior surface 72-1 of fuser roller 72. Referring to FIG. 3, when fuser detack mechanism 92 is in second position 100, the distal end 106 of each of the plurality of detack fingers 102 is positioned to be engaged with the exterior surface of fuser roller 72.

In the embodiment shown in FIGS. 2 and 3, each of bearing housings 86-1, 88-1 of bearings 86, 88, respectively, serve as a limit member for limiting the pivoting motion of fuser detack mechanism 92. Optionally, fuser roller 72 may serve as the limit member. Detack housing 94 has a limit stop 94-1, and optionally may include a second limit stop 94-2, as shown in FIG. 4.

Limit stop 94-1 of detack housing 94 includes a first stop member 108-1, a second stop member 110-1, and a proximal portion 112-1. In the present embodiment, first stop member 108-1 is a first elongate member that cantilevers outwardly from proximal portion 112-1 and second stop member 110-1 is a second elongate member that cantilevers outwardly from proximal portion 112-1, wherein the first elongate member diverges from the second elongate member with respect to proximal portion 112-1.

Likewise, limit stop 94-2 of detack housing 94 includes a first stop member 108-2, a second stop member 110-2, and a proximal portion 112-2. In the present embodiment, first stop member 108-2 is a first elongate member that cantilevers outwardly from proximal portion 112-2 and second stop member 110-2 is a second elongate member that cantilevers outwardly from proximal portion 112-2, wherein the first elongate member diverges from the second elongate member with respect to proximal portion 112-2.

As shown in FIGS. 2 and 3, first stop member 108-1 of limit stop 94-1 is positioned to engage bearing housing 86-1 (i.e., a limit member) when detack housing 94, and in turn fuser detack mechanism 92, is positioned in first position 98. Second stop member 110-1 is positioned to engage bearing housing 86-1 (i.e., a limit member) when detack housing 94, and in turn fuser detack mechanism 92, is pivoted to second position 100.

When in second position 100, the force that the plurality of detack fingers 102 applies against fuser roller 72 is controlled by stop members 110-1, 110-2 and the respective spring-loaded mechanisms 104.

The operation of stop members 108-2 and 110-2 with respect to bearing housing 88-1 is substantially the same as that described above with respect to stop members 108-1 and 110-1 with respect to bearing housing 86-1.

Fuser assembly 18 may further include a control circuit 114 and a sheet position sensor 116. Control circuit 114 is communicative coupled to each of actuator mechanism 90 and sheet position sensor 116, e.g., by electrical conductors. Actuator mechanism 90 includes an actuator (e.g., electromagnet) 90-1 and an actuator plate 90-2 (e.g., a steel plate). Actuator plate 90-2 is connected to detack housing 94. Actuator mechanism 90 is actuated by an electrical signal delivered by control circuit to actuator 90-1, thereby attracting actuator plate 90-2, and in turn positioning detack mechanism 92 at second position 100 as shown in FIG. 3.

Alternatively, the functions of control circuit 114 and sheet position sensor 116 may be performed by controller 42 in conjunction with media detection sensor 40.

Figure 5:
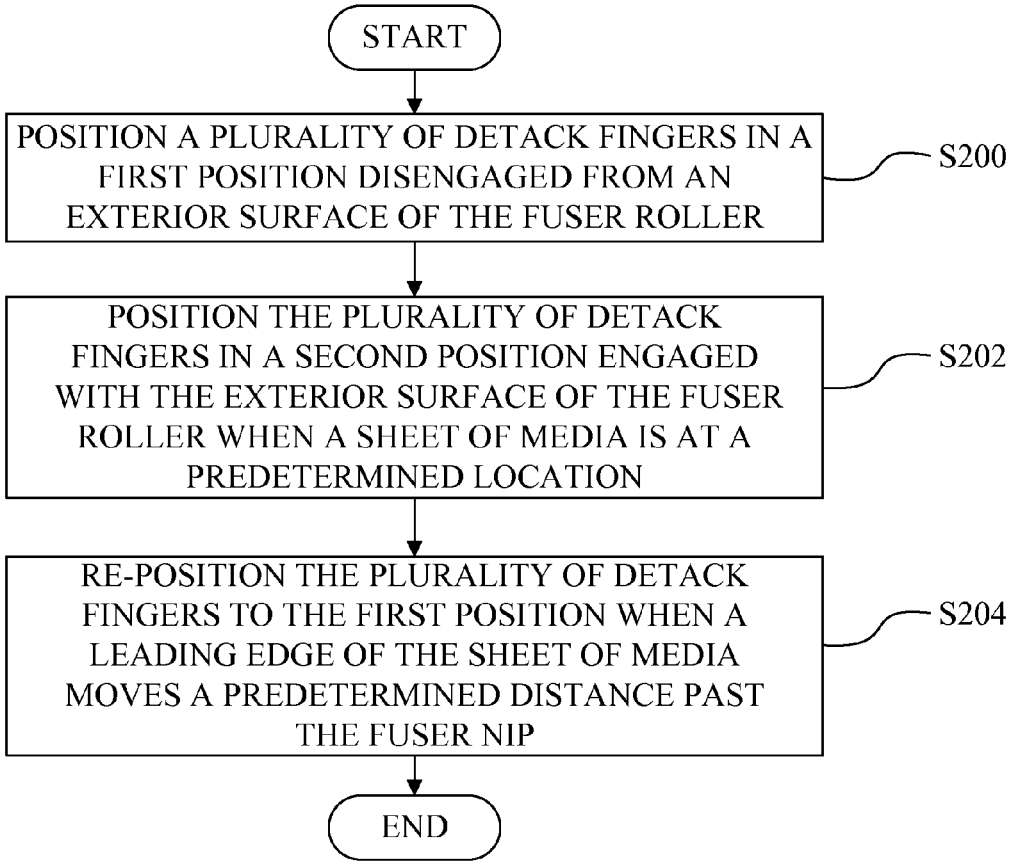
FIG. 5 is a flowchart depicting a method for operating the fuser assembly of FIG. 1.

FIG. 5 is a flowchart depicting a method for operating fuser assembly 18.

At act S200, the process initially positions the plurality of detack fingers 102 in first position 98 (see FIG. 2) so as to be disengaged from exterior surface 72-1 of fuser roller 72. This occurs by actuator mechanism 90 being de-actuated (e.g., de-energized) such that fuser detack mechanism 92 is positioned at first position 98 (see FIG. 2).

At act S202, the process positions the plurality of detack fingers 102 in second position 100 (see FIG. 3) so as to be engaged with exterior surface 72-1 of fuser roller 72 when the sheet of media 20-1 is at a predetermined location, such as a predetermined distance before, during or a predetermined distance after when the sheet of media 20-1 enters fuser nip 76. For example, when sheet position sensor 116 detects that the sheet of media 20-1 has entered fuser nip 76, then control circuit 114 may actuate (e.g., energize) actuator mechanism 90 to position fuser detack mechanism 92 at second position 100 (see FIG. 3) so that the plurality of detack fingers 102 is able to strip the sheet of media 20-1 from exterior surface 72-1 of fuser roller 72.

At act S204, the plurality of detack fingers 102 is repositioned to first position 98 when a leading edge of the sheet of media 20-1 moves a predetermined distance past fuser nip 76. In other words, once the danger that the sheet of media 20-1 may try to wrap around fuser roller 72 has past, then the plurality of detack fingers 102 are pivoted back out of contact with the exterior surface 72-1 of fuser 72 to first position 98

(see FIG. 2) to avoid unnecessary wear to fuser roller 72. For example, when sheet position sensor 116 detects that the leading edge of the sheet of media 20-1 has moved a predetermined distance past fuser nip 76, then control circuit 114 de-actuates (e.g., de-energizes) actuator mechanism 90 to re-position fuser detack mechanism 92 at first position 98 (see FIG. 2).

Thus, in accordance with the present invention, the position of the plurality of detack fingers 102 is selectable between non-contact and contact with fuser roller 72.

The plurality of detack fingers 102 may be controlled to stay in contact with exterior surface 72-1 of fuser roller 72, for example, until the sheet of media 20-1 is stretched tight between fuser nip 76 and exit nip 82. This may be accomplished, for example, by keeping the plurality of detack fingers 102 against exterior surface 72-1 of fuser roller 72 for the above-mentioned predetermined distance of travel of the leading edge of the sheet of media 20-1. This predetermined distance of travel of the leading edge of the sheet of media 20-1 is equal to the distance the distal end 106 of detack fingers 102 travel on exterior surface 72-1 of fuser roller 72.

The wear of exterior surface 72-1 of fuser roller 72 by the tips of detack fingers 102 is directly related to this predetermined distance. Also, the predetermined distance is a function of the media being printed. For example, cardstock can have a shorter distance than 60 g/$M^2$ paper because the cardstock is stiffer and does not produce as large a paper bubble between the exit of fuser nip 76 and exit nip 82. The life of fuser roller 72 is maximized by minimizing for each media type the distance the tips of detack fingers 102 travel on exterior surface 72-1 of fuser roller 72.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fuser assembly, comprising:

a fuser housing;

a fuser roller rotatably mounted to said fuser housing, said fuser roller having an exterior surface;

an actuator mechanism; and a fuser detack mechanism including:

a detack housing pivotably mounted to said fuser housing, said fuser detack mechanism being pivoted from a first position to a second position when said actuator mechanism is actuated, and a plurality of detack fingers mounted to said detack housing, each of said plurality of detack fingers having a distal end, wherein said fuser detack mechanism is in said first position, said distal end of each of said plurality of detack fingers is positioned to be disengaged from said exterior surface of said fuser roller, and when said fuser detack mechanism is in said second position, said distal end of each of said plurality of detack fingers is positioned to be engaged with said exterior surface of said fuser roller, wherein said detack housing is positioned in said first position by a force of gravity when said actuator mechanism is de-actuated.

2. A fuser assembly, comprising:

a fuser housing;

a fuser roller rotatably mounted to said fuser housing, said fuser roller having an exterior surface;

an actuator mechanism;

a fuser detack mechanism including:

a detack housing pivotably mounted to said fuser housing, said fuser detack mechanism being pivoted from a first position to a second position when said actuator mechanism is actuated, and a plurality of detack fingers mounted to said detack housing, each of said plurality of detack fingers having a distal end, wherein when said fuser detack mechanism is in said first position, said distal end of each of said plurality of detack fingers is positioned to be disengaged from said exterior surface of said fuser roller, and when said fuser detack mechanism is in said second position, said distal end of each of said plurality of detack fingers is positioned to be engaged with said exterior surface of said fuser roller; and a limit member mounted to said fuser housing;

wherein said detack housing having a first stop member and a second stop member, said first stop member being positioned to engage said limit member when said detack housing is positioned in said first position and said second stop member being positioned to engage said limit member when said detack housing is pivoted to said second position.

3. The fuser assembly of claim 2, wherein said limit member is a bearing housing of a bearing that rotatably mounts said fuser roller to said fuser housing.

4. The fuser assembly of claim 2, wherein said detack housing has a proximal portion, and wherein said first stop member is a first elongate member that cantilevers outwardly from said proximal portion and said second stop member is a second elongate member that cantilevers outwardly from said proximal portion, said first elongate member diverging from said second elongate member with respect to said proximal portion.

5. The fuser assembly of claim 2, wherein each detack finger of said plurality of detack fingers is pivotably mounted to said detack housing by a spring-loaded mechanism to bias said plurality of detack fingers in a direction toward said fuser roller.

6. The fuser assembly of claim 2, further comprising:

a backup roller positioned in engagement with said fuser roller to form a fuser nip; and a control circuit communicatively coupled to said actuator mechanism, said actuator mechanism being actuated by said control circuit when a sheet of media is at a predetermined location.

7. The fuser assembly of claim 6, wherein said actuator mechanism is de-actuated by said control circuit when a leading edge of said sheet of media moves a predetermined distance past said fuser nip.

8. An imaging apparatus for forming a toner image on a sheet of media, composing:

a media feed section for feeding said sheet of media along a media feed path in a sheet feed direction;

a laser scanning device configured to produce a scanned light beam;

an image-forming device having a photosensitive body, and configured to use said scanned light beam to form a latent image on said photosensitive body and develop said latent image to form a toner image that is transferred to said sheet of media;

an actuator mechanism;

a control circuit communicatively coupled to said actuator mechanism;

a fuser housing;

a fuser roller rotatably mounted to said fuser housing, said fuser roller having an exterior surface;

a fuser detack mechanism including:

a detack housing pivotably mounted to said fuser housing, said fuser detack mechanism being pivoted from a first position to a second position when said actuator mechanism is actuated, and a plurality of detack fingers mounted to said detack housing, each of said plurality of detack fingers having a distal end, wherein when said fuser detack mechanism is in said first position, said distal end of each of said plurality of detack fingers is positioned to be disengaged from said exterior surface of said fuser roller, and when said fuser detack mechanism is in said second position, said distal end of each of said plurality of detack fingers is positioned to be engaged with said exterior surface of said fuser roller; and a limit member mounted to said fuser housing, wherein said detack housing having a first stop member and a second stop member, said first stop member being positioned to engage said limit member when said detack housing is positioned in said first position and said second stop member being positioned to engage said limit member when said detack housing is pivoted to said second position.

9. The imaging apparatus of claim 8, wherein said limit member is a bearing housing of a bearing that rotatably mounts said fuser roller to said fuser housing.

10. The imaging apparatus of claim 8, wherein said detack housing has a proximal portion, and wherein said first stop member is a first elongate member that cantilevers outwardly from said proximal portion and said second stop member is a second elongate member that cantilevers outwardly from said proximal portion, said first elongate member diverging from said second elongate member with respect to said proximal portion.

11. The imaging apparatus of claim 8, wherein each detack finger of said plurality of detack fingers is pivotably mounted to said detack housing by a spring-loaded mechanism to bias said plurality of detack fingers in a direction toward said fuser roller.

12. The imaging apparatus of claim 8, wherein said detack housing is positioned in said first position by a force of gravity when said actuator mechanism is de-actuated.

13. The imaging apparatus claim 8, further comprising a backup roller positioned in engagement with said fuser roller to form a fuser nip, said actuator mechanism being actuated by a controller when a sheet of media is at a predetermined location.

14. The imaging apparatus of claim 13, wherein said actuator mechanism is de-actuated by said controller when a leading edge of said sheet of media moves a predetermined distance past said fuser nip.

15. The imaging apparatus of claim 8, wherein said actuator mechanism, said fuser roller and said fuser detack form a fuser assembly.

16. The imaging apparatus of claim 15, wherein said control circuit is incorporated into said fuser assembly.

* * * * *